US005150978A

United States Patent [19]

Stewart et al.

[11] Patent Number: 5,150,978

[45] Date of Patent: Sep. 29, 1992

[54] WAX APPLICATOR WITH RUBBER BUMPER END

[76] Inventors: Bryan J. Stewart; Victoria J. Stewart, both of 125 S. Santa Ynez, Santa Barbara, Calif. 93103

[21] Appl. No.: 736,712

[22] Filed: Jul. 26, 1991

[51] Int. Cl.[5] ..... A47L 13/30

[52] U.S. Cl. ..... 401/14; 401/6; 401/68; 401/82; 401/98; 401/173

[58] Field of Search ..... 401/173, 14, 6, 82, 401/98, 68

[56] References Cited

U.S. PATENT DOCUMENTS

| | | | |
|---|---|---|---|
| 1,203,308 | 10/1916 | Brown | 401/173 |
| 1,667,118 | 4/1928 | Keck | 401/82 |
| 1,780,508 | 11/1930 | Schulse | 401/82 |
| 2,130,223 | 9/1938 | Beaurline | 401/14 |
| 2,168,876 | 8/1939 | Noyack . | |
| 2,205,808 | 6/1940 | Bolinger | 401/173 |
| 2,328,973 | 9/1943 | Goldfisher | 401/173 X |
| 2,336,328 | 12/1943 | Whalen . | |
| 2,344,060 | 3/1944 | Ray . | |
| 2,374,065 | 4/1945 | Worthington | 401/173 |
| 2,457,342 | 12/1948 | Braselton . | |
| 2,595,403 | 5/1952 | Neuschaefer . | |
| 2,610,732 | 9/1952 | Calhoun . | |
| 3,070,823 | 1/1963 | Heinig | 401/6 |
| 4,768,531 | 9/1988 | Broussard . | |
| 4,890,944 | 1/1990 | Cousins | 401/173 X |

FOREIGN PATENT DOCUMENTS

| | | | |
|---|---|---|---|
| 648315 | 12/1928 | France | 401/173 |
| 1068906 | 7/1954 | France | 401/173 |
| 324800 | 2/1935 | Italy | 401/173 |

*Primary Examiner*—Steven A. Bratlie
*Attorney, Agent, or Firm*—W. Douglas English

[57] ABSTRACT

A storage container and applicator for sports wax is construed using an ergonomically molded hollow case with a plunger for forcing wax from the case. A cap is attachable to the case so that the contaminants will be kept from the wax, and wax kept from clothing or other sensitive surfaces. The container has a beveled outlet with a soft rubber bumper ring which is designed to safely and economically facilitate wax application while the user maintains a natural and comfortable hand position. A series of wax anchors keeps the wax in close contact with the movable plunger for forcing wax out of, or into the tube.

4 Claims, 2 Drawing Sheets

WAX APPLICATOR WITH RUBBER BUMPER END

BACKGROUND

Figure 3A:
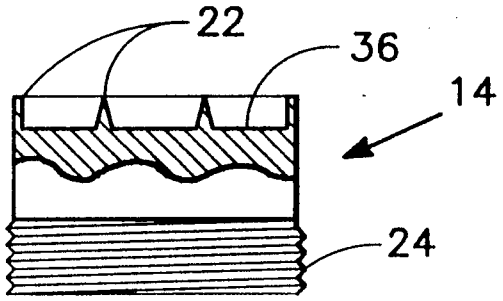

The present invention relates to an applicator and storage device for sports wax, and in particular, one in which the wax may be retracted into or extended from a hollow cylindrical case.

Surfers, skiers, sailors and other water sports enthusiasts often find that the application of wax to their water or snow vehicle's surface will greatly enhance its performance. A wax coating on the deck of a surfboard or sailboat increases the traction between the user's body and the boat or board and facilitates the user in maintaining balance. Conversely, wax applied to the bottom of snow skis repels snow and allows varying degrees of frictional drag, depending on the wax composition, between the snow and skis.

Presently, wax for water sports use is sold in cakes, which are usually wrapped in plastic or paper. The wax is held directly in the palm of the hand and applied by rubbing. An object of this invention is to provide a sealable storage container to prevent wax cakes from being contaminated by sand, dirt or other debris. This container will hold a stack of several of the standard cylindrical wax cakes commercially available.

Another object of the invention is to provide a large and comfortable gripping area for the application of wax. The container is anatomically designed to accommodate four fingers in grooves and give the palm a high friction gripping area. The outlet of the container is beveled to position the user's hand in the most natural and efficient angle while distributing wax.

A further advantage of the invention is that only a tiny portion of the wax, toward the end of the stack of cakes, is unusable. Without the present invention, much of a cake of wax is discarded due to either the user's inability to grip the increasingly smaller remains of the cake, the contamination of, or loss of the wax. The net result, therefore, of this invention is a cost savings to the user due to decreased wax waste. The decrease in wax waste will also decrease environmental pollution.

Additionally, without the present invention, wax is more susceptible to melting, becoming misshapen or soiling the users skin or clothing. The invention prevents wax from contacting or contaminating other materials. This is especially useful when clothing, tools, cameras, and other equipment are packed together with wax bars as while traveling.

Another advantage of the invention is that it is refillable and reusable. As wax plugs are depleted through application, they may be replaced.

Yet another advantage of the invention is that animals and birds that are customarily attracted to the bright colors of wax and strong aroma thereof will be prevented from finding and eating loose wax cakes lying idly on the beach, in the water, or natural environment.

A lightweight, easily held, and sealable wax applicator would represent a major advantage in the sports wax application technology and would satisfy a long felt need in the field of applying waxes to sporting equipment.

SUMMARY

The present invention for storing and applying sports wax products satisfies these needs. The present invention is a device for containing and easily applying a cylinder of wax or a plurality of individual wax cakes melted together to form a wax cylinder. A cylindrical of wax is stored in a tubular body which is anatomically shaped to fit naturally and comfortably in the hand. The wax cylinder is anchored to a plunger which moves along the inner surface of the body and forces the wax into or out of the tubular body. A removable cap entirely seals the wax from the outside environment when not in use.

The present invention utilizes a hollow plastic molded body which has a series of grooves to accommodate the user's fingers and a knurled or rough surface opposite the grooves to prevent the body from slipping in the user's palm. A plunger fits inside the body and, through matched threaded surfaces, moves along the body's length when rotated. The plunger has wax anchors especially designed to hold the wax on the plunger. The plunger also has thumb and finger indents with a torsion bar between them. In this arrangement, rotating the plunger, with the thumb and finger fitted into the indents and acting on the torsion bar, moves the wax out of, or retracts the wax into the hollow body.

The present invention offers an applicator which, through use of molded wax anchors, makes available for use virtually the entirety of the cylinder of wax inside the tubular container. Abrasive contact of the tubular container is prevented by a circular, soft rubber grommet surrounding the opening of the container.

These and other features, aspects, and advantages of the present invention will become better understood with reference to the following description, appended claims, and accompanying drawings.

DRAWINGS

Figure 1:
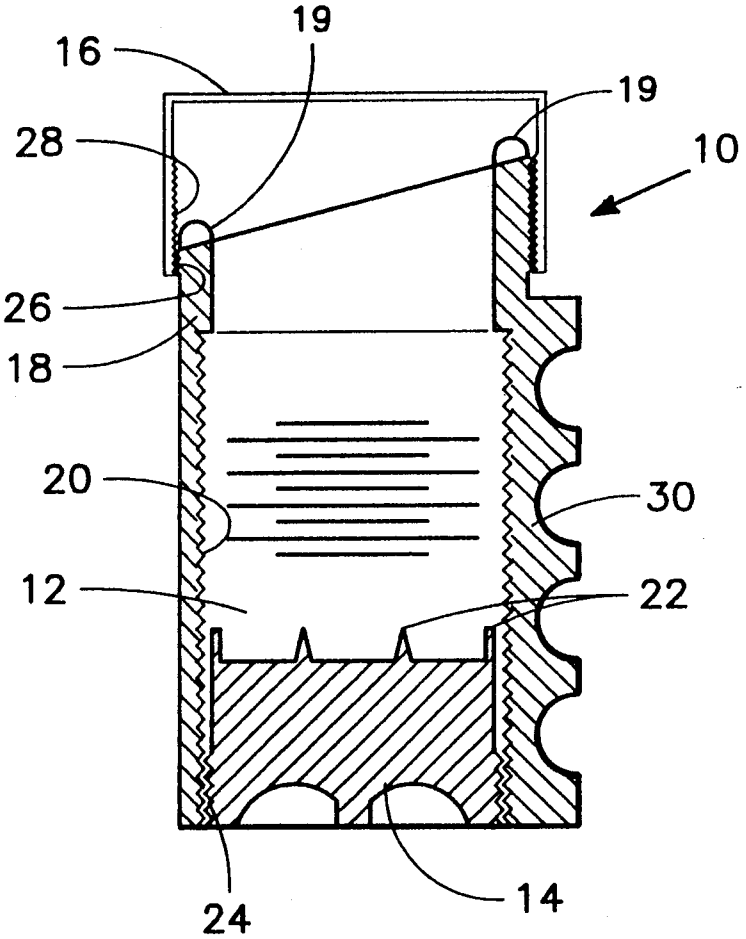

FIG. 1 is a view of the wax applicator including its components: the tubular body with the soft rubber grommet, the plunger base and the cap. The relative engagement of the threaded surfaces of these components is also depicted.

Figure 2A:
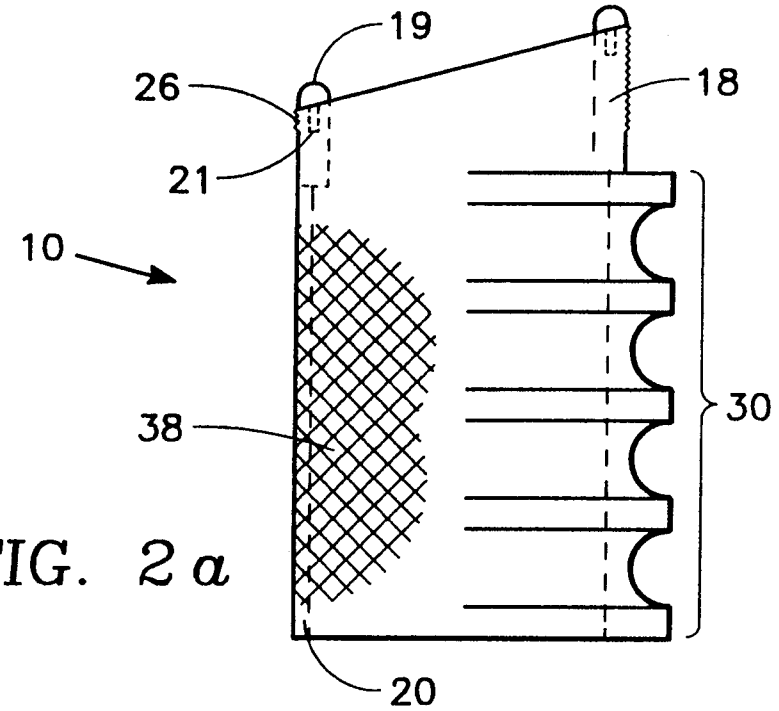

FIG. 2*a* is a side view of the tubular body showing the molded finger grips, soft rubber grommet, the knurled surface, interior and exterior threaded faces and the plunger stop.

Figure 2B:
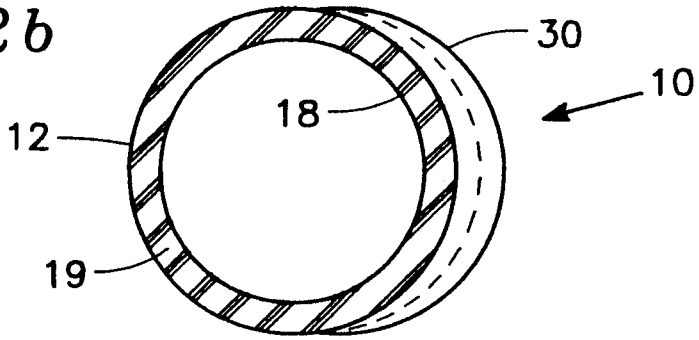

FIG. 2*b* is a top view of the tubular body.

FIG. 3*a* is a side view of the plunger base wherein the wax anchors, and plunger's outer threaded surface, are shown.

Figure 3B:
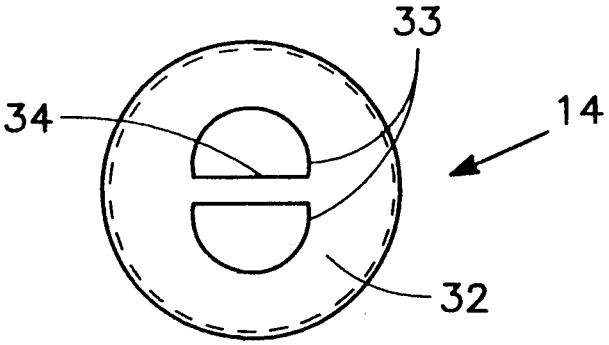

FIG. 3*b* is a bottom view of the plunger base illustrating finger and thumb indents and torsion bar.

FIG. 4 shows the cap in end view and side view and the threaded surface on the interior face of the open end.

Figure 4A:
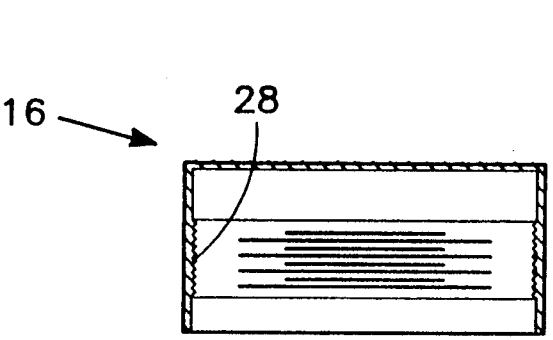
Figure 4B:
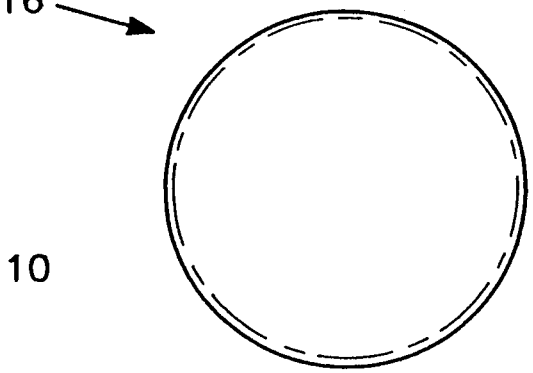

FIG. 4*b* illustrates a top view of the cap.

DESCRIPTION

With reference to FIG. 1, a wax container device 10 for storing and applying wax is shown A frame 12, plunger 14 and end cap 16 are the three components which comprise the applicator 10. The rigid tubular frame 12 has an interior threaded surface 20 and an exterior threaded end 26. Circumferentially contained within the threaded end 26, and integral to the frame 12 is a plunger stop ring 18. Circumferentially riding plunger stop ring 18 is a firmly attached soft rubber grommet ring 19 which prevents abrasive contact of stop ring 18 with any surface to which wax is being applied. Also integral to the frame 12, and partially surrounding the interior threaded surface 20, is a projection containing finger grips 30. The plunger 14 has a threaded outer surface 24 which may be engaged with the interior threaded surface 20 of the tubular body 12. The interior threads of the body 20 and the plunger threads 24 being engaged, rotation of the plunger 14 will cause the plunger 14 and a cake of wax, affixed to the wax anchors 22, to translate along the longitudinal axis of the tubular body 12. An end cap 16 has a threaded interior 28 near its open end. The cap threaded interior 28 may be removably threaded onto the outer threaded surface 26 of the tubular frame 12.

In the preferred embodiment, the tubular frame 12 of FIG. 2 is made of plastic with the interior 20 and exterior 26 threads, stop ring 18, grommet ring 19, finger grip projection 30 and a high friction exterior surface finish 38 molded as an integral unit. Grommet ring 19 is provided with anchor lip 21 circumferentially positioned in a groove in the external periphery of stop ring 18. The tubular body will have the general shape of a hollow right cylinder slightly oblong in cross sectional view, (FIG. 2*b*) and one end which is inclined by 5 degrees to 20 degrees with respect to the second end. The greatest overall length of the cylinder is about 4.75 inches and the greatest outside dimension in the preferred embodiment is between 2.25–2.75 inches. The assembly 10 is intended to accommodate cylindrical plugs of wax having a diameter of about 1.63 inches and an overall height of 3.5–4.5 inches in total.

With reference to FIGS. 3*a* and 3*b*, the plunger base 14 is shown in two views side and bottom, respectively. The plunger base 14 has the general form of two stacked cylinders, one nearly the diameter of the interior threaded surface 20 of the tubular body 12, and one slightly larger than the inside diameter of the stop ring 18. The plunger has a wax face 36 from which a series of wax anchors 22 protrude. The plunger has a turning face 32 having indentations 33 from which a thumb and finger can apply torque to the torsion bar 34 and the plunger 14. The torsion bar 34 is integrally molded into or solidly attached to the plunger 14. The cylindrical section of the plunger 14 having a diameter nearly that of the interior threaded surface 20 is also threaded 24 such that the two may engage. These threads are cut to a depth of 1/16 inch in the preferred embodiment, though a variety of threads or spiral cuts may function equivalently in this invention.

The plunger 14, in its preferred embodiment, is a single unit molded of plastic. The wax anchors 22 will be conical or cuboid in shape, or have other geometries, and project to a height of approximately ½ inch beyond the wax face 36. Other sizes or geometries of wax anchors 22 may work equally well in adhering wax to the plunger face 36. When a wax plug is brought into close contact with the wax face 36, the anchors 22 will displace a portion of wax equivalent to their volume and aid in maintaining contact between the wax and plunger 14. Several anchors 22 located near the perimeter of the plunger 14 are meant to generally align wax plugs and the plunger 14 with respect to their longitudinal axes. The anchors 22, in the preferred embodiment, should be dimensioned in coordination with the stop ring 18 such that, when the stop 18 has prevented plunger 14 motion along the longitudinal axis of the tubular body 12, the anchors 22 do not substantially project beyond the circumferential confines of the body 12.

With reference to FIGS. 4*a* and 4*b* the protective cap 16 is illustrated from an end view and side view, respectively. The cap 16 is a hollow cylinder, closed at one end, and with an interior threaded surface 28 located at the open end. In the preferred embodiment, the diameter of the protective cap 16 is about 2.25–2.75 inches and the wall thickness is near 1/16 of an inch, but always such that the interior threads 28 may engage with the exterior threads 26 of the hollow body 12. The preferred material for construction of the cap 16 is moldable plastic. The cap 16, body 12 and plunger 14 would, in the preferred embodiment, be molded of a brightly colored plastic to facilitate their location visually.

What is claimed is:

1. A device for storing and applying wax-like substances comprising:

a tubular body having a threaded interior surface and a threaded exterior end, said exterior end being beveled;

a compliant ring affixed to said beveled end of said tubular body;

a plunger base having a plurality of projecting wax anchors for removably affixing solid wax to said base, said base being generally cylindrical and having a threaded exterior surface for engaging with said tubular body's threaded interior surface, said plunger base having a thumb and finger groove oppositely disposed from said wax anchors;

a closed end cap having a threaded open end, said cap being threaded for removable engagement with said tubular body's threaded exterior end; and means for threading said plunger base along said interior surface thereby moving any wax affixed to said anchors, in an undeformed manner, toward said threaded exterior end of said body and, without interference, beyond the circumferential confines of said body;

whereby said compliant ring affixed to said beveled end of said tubular body prevents abrasive contact between said tubular body and an object being waxed.

2. The device of claim 1 wherein said tubular body has a plurality of radial grooves on an exterior surface, said radial grooves designed such that several fingers may be partially contained within said grooves while gripping said body, said exterior surface also being knurled.

3. A device for applying and storing wax comprising:

a generally tubular frame means for containing wax, said frame means having an angled dispenser end;

a plunger means for translating wax, in an undeformed manner, along a longitudinal axis of said frame means;

a plurality of wax anchor means for connecting said wax to said plunger means, said anchor means being integrally attached to said plunger means and generally orthogonally disposed with respect to said plunger means;

a brake means for preventing said anchor means from extending beyond the generally circumferential confines of said tubular frame means;

soft contact means disposed on said brake means for preventing abrasive contact between said tubular frame means and a surface to be waxed;

a removable threaded cap means for enclosing an open end of said tubular frame means; and a plurality of threaded means for mutually engaging and facilitating relative movement between said frame means, said plunger means, and said removable threaded cap means.

4. The device of claim 3 wherein said tubular frame means has a plurality of integral radial grooves on an exterior surface, said radial grooves designed such that several fingers may be partially contained within while gripping said applicator frame means, said exterior surface also being rough.

* * * * *